US008415034B2

(12) United States Patent
Kuribayashi

(10) Patent No.: US 8,415,034 B2
(45) Date of Patent: Apr. 9, 2013

(54) HIGH-TOUGHNESS WEAR-RESISTANT COMPOSITE MATERIAL AND A METHOD OF MANUFACTURING THE SAME

(75) Inventor: Nobuhiro Kuribayashi, Kashiwazaki (JP)

(73) Assignee: TIX Corporation, Tokyo (JP)

( * ) Notice: Subject to any disclaimer, the term of this patent is extended or adjusted under 35 U.S.C. 154(b) by 168 days.

(21) Appl. No.: 12/659,358

(22) Filed: Mar. 5, 2010

(65) Prior Publication Data

US 2010/0316880 A1 Dec. 16, 2010

(30) Foreign Application Priority Data

Jun. 16, 2009 (JP) ..... 2009-142837

(51) Int. Cl.
*B22F 7/04* (2006.01)
*C22C 26/00* (2006.01)
*C22C 29/08* (2006.01)

(52) U.S. Cl.
USPC ..... 428/698; 428/545

(58) Field of Classification Search ..... 75/236, 75/240; 428/698, 545; 228/262.1
See application file for complete search history.

(56) References Cited

U.S. PATENT DOCUMENTS

| | | | | |
|---|---|---|---|---|
| 3,036,907 | A * | 5/1962 | Bibbins | 75/231 |
| 3,049,435 | A * | 8/1962 | Shwayder | 427/191 |
| 4,525,178 | A | 6/1985 | Hall | |
| 4,604,106 | A | 8/1986 | Hall et al. | |
| 4,694,918 | A | 9/1987 | Hall | |
| 5,119,714 | A | 6/1992 | Scott et al. | |
| 5,271,547 | A * | 12/1993 | Carlson | 228/122.1 |
| 7,637,981 | B2 | 12/2009 | Kuribayashi et al. | |

FOREIGN PATENT DOCUMENTS

| | | | |
|---|---|---|---|
| CN | 1055397 | A | 10/1991 |
| CN | 101446199 | A | 6/2009 |
| JP | 09-078986 | A | 3/1997 |
| JP | 09-194909 | A | 7/1997 |
| JP | 3309897 | B2 | 5/2002 |
| JP | 2005-076115 | A | 3/2005 |
| WO | WO-2006/080302 | A1 | 8/2006 |

OTHER PUBLICATIONS

Office Action in Japanese Patent Application No. 2009-142837, dated Apr. 19, 2011.
Office Action in Chinese Patent Application No. 201010132322.3, dated Jul. 29, 2011.

* cited by examiner

*Primary Examiner* — Roy King
*Assistant Examiner* — Ngoclan T Mai
(74) *Attorney, Agent, or Firm* — Fishman & Grauer PLLC

(57) ABSTRACT

A composite wear-resistant member and a method of manufacturing the same. The method includes setting an appropriate sintering temperature from 900° C. to 1080° C. by adjusting a ratio of phosphor in a material, wherein the material contains hard particles including diamond particles and WC particles, a binder of an iron group metal containing phosphor (P), and copper, which is distributed and is present alone; and performing hot press sintering or electric discharge sintering on the material. The composite wear-resistant member includes a material including hard particles including diamond particles and WC particles, a binder of an iron group metal containing phosphor, and copper. The phosphor content is from 0.01 to 1.0 wt % with respect to the sum total of the WC particles and the binder.

3 Claims, 3 Drawing Sheets

HIGH-TOUGHNESS WEAR-RESISTANT COMPOSITE MATERIAL AND A METHOD OF MANUFACTURING THE SAME

INCORPORATION BY REFERENCE

The present application claims priority from Japanese application JP2009-142837 filed on Jun. 16, 2009, the content of which is hereby incorporated by reference into this application.

BACKGROUND OF THE INVENTION (1) Field of the Invention

The present invention relates to a composite wear-resistant member that has high hardness and density and contains super-hard particles (e.g. diamond particles or cubic boron nitride (cBN) particles) and, more particularly, to composite wear-resistant member that is excellent in heat and pressure shock-resistant characteristics, and a method of manufacturing the same.

(2) Description of related art

Hard metals are generally used for wear-resistant tools as in petroleum drilling due to high toughness and wear resistance. Recently, composite materials (e.g. polycrystalline diamond compacts (PDC)) joining a diamond composite material to the hard metal under very high pressure at high temperature have been frequently used.

These sintered compacts containing diamond particles are manufactured under very high pressure at high temperature. However, a method of manufacturing a sintered compact of diamond, tungsten carbide (WC), and ferrous metal under low pressure rather than high pressure has recently studied (JP-B2-3309897 and WO2006-080302A1 (U.S. Pat. No. 7,637,981)).

However, all the diamond composite materials whether the PDCs manufactured under very high pressure or the diamond composite materials manufactured under low pressure have a fundamental problem in that cracks or defects may occur due to shock caused by heat or pressure.

To overcome this problem, various attempts have been made (U.S. Pat. Nos. 5,119,714, 4,604,106, 4,525,178, 4,694,918 and JP-A-9-194909). Although some effects are recognized, the inventions disclosed in these documents do not yet provide a fundamental means that has many countermeasures against the stress of joints and prevents generation and propagation of distortion caused by shock by reinforcing the material itself.

BRIEF SUMMARY OF THE INVENTION

All WC-based diamond composite materials used for petroleum drilling bits are subjected to micro-cracks by severe wear and shock against rock, and the micro-cracks propagate and grow to cause exfoliation. Further, the composite materials expand due to the heat of earth and the heat of friction resulting from friction with rock, and thus stress accumulates in the composite materials, and generates the cracks.

Thus, careful attention is required to use composite materials.

If the composite materials do not employ tough materials for preventing cracks from being generated and propagated, they cannot be reliably used for places where severe shock-resistant wear occurs as in petroleum drilling. It requires enormous cost and time to replace a tool such as a petroleum drilling bit that suffers a loss. Even in a process of manufacturing such a bit, it is a trouble that gives rise to cracks when the diamond composite material is brazed. Owing to these circumstances, there is a strong demand for providing a tough diamond composite material that is highly resistant to pressure and heat shocks.

The present invention is mainly directed to endow a diamond composite wear-resistant member with characteristics highly resistant to pressure and heat shocks.

The present inventor paid attention to ductility and thermal conductivity of metal copper. In detail, when the metal copper was dispersed and laminated into the composite material, the thermal conductivity of the copper prevented local heating of the member, and the ductility of the copper absorbed shock force. Thereby, even if cracks occur, propagation thereof can be prevented. Further, the copper was preferentially worn when used, and thus a knife edge was formed to enhance drilling efficiency.

In addition, the inventor paid attention to a fact that brazability was improved due to the presence of the copper.

Meanwhile, sintering temperature of WC-based alloys is generally 1300° C. or more, and the copper has a melting point of 1083° C. As such, when the metal copper is dispersed and sintered, the copper is dissolved and dispersed into the WC-based composite material, thereby extremely softening WC joints to fail to produce original characteristics.

Thus, it is impossible to disperse the copper into the hard metal.

In contrast, the composite material proposed in Japanese Patent Application No. 2005-016581 (WO 2006-080302A1) is characteristic of low-temperature sintering of 1100° C. or less.

The copper differs from iron in that it does not reduce the melting point due to alloying with carbon. Further, copper is hardly influenced by phosphor, and reacts with phosphor to only slightly reduce the melting point.

In one aspect of the invention, the metal copper is mixed with and dispersed into powder for sintering the diamond composite material, which contains WC as a main component and uses an iron group metal containing the phosphor as a binder, and the mixture is sintered by a typical hot press method. As a result, it is found that the copper is not dissolved and remains as metal copper in the state when mixed on the conditions: 1050° C., 300 kg/cm$^2$, and 30 minutes.

The sintered composite material is cooled in a pressurized situation after the sintering is terminated, and thus stress between the metal and the composite material occurs accompanied with a decrease in temperature. The copper metal is deformed by continuing the pressurized state, thereby relieving the stress. Thereby, it is possible to manufacture a new composite material in which a trace of copper metal is dispersed into the hard diamond composite material.

In another aspect of the invention, a sheet or network of copper metal is fitted into the diamond composite material so as to have a laminated structure, and then is subjected to hot press sintering. As a result, it is possible to manufacture a new composite material in which a copper metal sheet or network and the diamond composite material have a sandwich structure.

According to the present invention, two types of new diamond composite wear-resistant member having high resistance to the heat and pressure shocks can be obtained using the copper. The first type is a composite material in which copper is dispersed into the WC-based diamond composite material and the composite material in which the WC-based diamond composite material. The second type is a copper metal sheet are subjected to hot press sintering in a sandwich shape.

In general, according to the present invention, a diamond composite material for a bit into which copper is dispersed, and a completely new diamond composite material for a bit in which a copper sheet or network and the diamond composite material are laminated, and a method of manufacturing the same are provided.

In detail, according to the present invention, the method of manufacturing a composite wear-resistant member includes steps of setting an appropriate sintering temperature from 900° C. to 1080° C. by adjusting the ratio of phosphor in a material, wherein the material contains hard particles including diamond particles and WC particles, a binder of an iron group metal containing phosphor (P), and copper, which is distributed and is present alone; and performing hot press sintering or electric discharge sintering on the material.

Further, according to the present invention, in the method of manufacturing a composite wear-resistant member, the hot press sintering or electric discharge sintering may be performed after a base layer, which has hard particles including the diamond particles and the WC particles and the binder of an iron group metal containing phosphor (P), and a layer including copper are stacked.

Furthermore, according to the present invention, in the method of manufacturing a composite wear-resistant member, the phosphor may have a content of 0.01 to 1.0 wt % with respect to the sum total of the WC particles and the binder.

Furthermore, according to the present invention, a composite wear-resistant member may include a material including hard particles including diamond particles and WC particles, a binder of an iron group metal containing phosphor, and copper, which is distributed and is present alone, the phosphor having a content of 0.01 to 1.0 wt % with respect to the sum total of the WC particles and the binder.

Furthermore, according to the present invention, the composite wear-resistant member may include a base layer, which has the hard particles including the diamond particles and the WC particles and the binder of an iron group metal containing the phosphor, and a layer including the copper, and the phosphor content is from 0.01 to 1.0 wt % with respect to the sum total of the WC particles and the binder.

In the method of manufacturing the above composite wear-resistant member and the composite wear-resistant member, the copper may be, for instance, a thin wire.

Further, the diamond particles may be replaced by cBN particles.

The present invention has a greatest feature in that the metal copper is dispersed into the material including the super-hard particles including the diamond particles and the phosphor (P) containing binder. The ratio of the phosphor is adjusted such that the appropriate sintering temperature of the material including the super-hard particles comprising the diamond particles and the phosphor-containing binder ranges from 900° C. to 1080° C., so that it is possible to perform the hot press sintering or electric discharge sintering at low temperature. Since the appropriate sintering temperature is low, the surfaces of the diamond particles are not deteriorated to form a layer of carbide.

The copper remains in the WC-based diamond composite material in the state of the metal copper without being dissolved, so that it well absorbs the shock applied to the material, and thus prevents generation of the cracks. If the micro-cracks are generated, the copper metal prevents the expansion and propagation of the micro-cracks, and thus the propagation of the cracks is inhibited by the metal copper part. The local heating is inhibited by the heat conduction of the copper, so that it can be seen that the material well withstands heat shock. A cooling effect increases, and thus the brazability is greatly improved.

Further, the copper metal part is rapidly worn by wear against rock, and thus grooves or concaves are formed in the surface of the WC-based diamond composite material, so that chip removal improves, and thus cutting efficiency is improved.

As described above, shock resistance to pressure and heat, which is strongly required for the WC-based diamond composite material for the bit, can be given.

The composite wear-resistant member is manufactured by hot press sintering or electric discharge sintering. The hot press sintering performs induction heating and sintering on a graphite coil or die during pressure forming, and the electric discharge sintering performs heating and sintering by applying pulse current to a graphite die during pressure forming. The reason the lower limit of the sintering temperature is set to 900° C. is because a liquid phase occurs in the iron group metal containing the phosphor at about 880° C., and thus the sintering is sharply accelerated. The reason the upper limit of the sintering temperature is set to 1080° C. is because the copper is dissolved on a temperature region higher than the set temperature.

The super-hard particles include the diamond particles and WC particles, and the binder includes the phosphor-containing iron group metal. The phosphor content is from 0.01 to 2.0% by weight with respect to the sum total of the WC and the iron group metal.

An added amount of the phosphor is set on the basis of a sintering temperature of about 1000° C. from the standpoint of preventing deterioration and carbonation of the diamond. In consideration of strength of the composite wear-resistant member, the content of the phosphor preferably has an upper limit of 1.0%.

The diamond particles as the super-hard particles are individually independent of each other, and are dispersed in the WC and the iron group metal containing phosphor. The diamond particles have a content of 1 to 60% by volume.

The reason the added upper limit of the diamond is set to 60% by volume is because the composite wear-resistant member cannot obtain sufficient toughness with respect to the shock when the added upper limit of the diamond is more than 60% by volume. The reason the added lower limit of the diamond is set to 1% by volume is because the composite wear-resistant member cannot expect an effect on wear-resistance performance when the added lower limit of the diamond is less than 1% by volume. The added amount of the diamond preferably ranges from 5 to 40% by volume. Further, the phosphor-containing iron group metal as the binder ranges from 3 to 30% by weight. If the phosphor-containing iron group metal is less than 3% by weight, it is impossible to obtain sufficient toughness from the material, and to sufficiently protect the diamond particles from the shock. If the phosphor-containing iron group metal is more than 30% by weight, it is impossible to obtain sufficient matrix hardness (wear-resistance) toughness. Thus, the phosphor-containing iron group metal preferably ranges from 6 to 25% by weight.

If the diamond particles as the super-hard particles have a diameter of 5 μm or less, the surface area increases, and thus the carbonation of the diamond increases. Further, when sintered, circulation of the liquid phase is degraded, and thus the sinterability is apt to cause trouble.

Instead of the diamond particles, cBN particles may be used. In this case, the cBN particles may have a diameter of 5 μm or less.

Other objects, features and advantages of the invention will become apparent from the following description of the embodiments of the invention taken in conjunction with the accompanying drawings.

DETAILED DESCRIPTION OF THE INVENTION

EXAMPLE 1

87 wt % of WC powder having a diameter of 2 μm, 10 wt % of Co having a diameter from 2 μm to 3 μm, and 3 wt % of NiP (P content of 10.7%, 400 mesh or less) were measured and were subjected to ball mill mixing in alcohol for 48 hours. 300 g was extracted from the mixed powder, 10 g of diamond having a diameter from 40 μm to 50 μm was added. Mixing was performed in an alcohol solution, followed by drying.

4 g of the powder (i.e, compact), produced as above, was input into a carbon mold having a length of 25 mm and a width of 10 mm, and was subjected to pre-pressing at 200 kg/cm$^2$, thereby forming a base layer. A thin copper film (i.e., a copper layer) having a thickness of 0.4 mm was placed on the base layer. 4 g of the prepared powder was added on the copper film, followed by pre-pressing, thereby forming a base layer. A thin copper film (i.e., a copper layer) having a thickness of 0.4 mm was placed on the base layer again. By repeating these process steps, a pressed product including four layers of composite material and three plies of copper films was prepared in the carbon mold. Then, the pressed product was subjected to hot pressing in N2 gas at conditions, in which a pressure of 40 MPa and a temperature of 1000° C. were maintained for 30 minutes. It was possible to produce a composite wear resistant member, in which diamond particles of 10% in volume are distributed across a minute structure of the WC and the phosphor-containing iron group metal.

Figure 1:
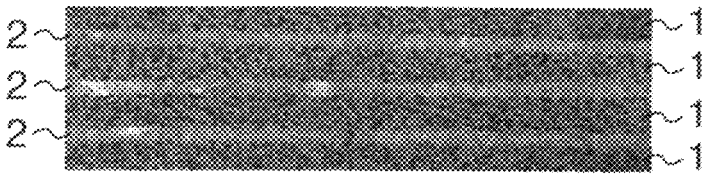
FIG. 1 is a view showing a structure photograph of a wear-resistant composite material according to a first embodiment of the present invention.
Figure 2:
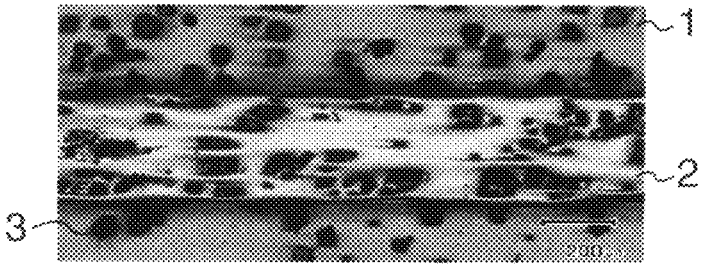
FIG. 2 is a view showing a structure photograph of a wear-resistant composite material according to a first embodiment of the present invention.
Figure 3:
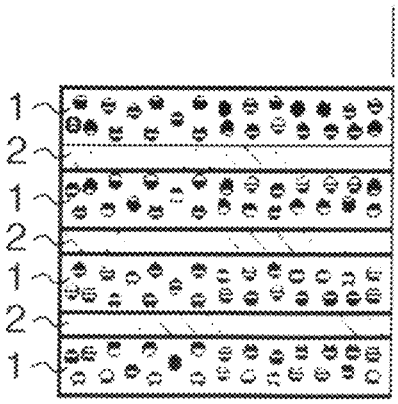
FIG. 3 is a schematic view drawing the structure photograph of FIG. 1.

The results observed using an optical microscope are shown in FIGS. 1 and 2. In these figures, the reference numeral 1 designates matrix of a super-hard alloy (HV.1400), the reference numeral 2 designates copper films, and the reference numeral 3 designates diamond particles. FIG. 1 shows four plies of the copper films 2, FIG. 2 shows only one ply of the copper films 2, and FIG. 3 is a view schematically showing FIG. 1.

As shown in these figures, the copper is regularly present on the layers, showing a fine appearance without defects.

In an attempt to cut the composite wear resistant member by wire discharge processing, it was able to cut the member without difficulties.

In addition, brazing was also easy due to good lead adaptability, and no defects were observed.

EXAMPLE 2

87 wt % of WC powder having a diameter of 2 μm, 10 wt % of Co having a diameter from 2 μm to 3 μm, and 3 wt % of NiP (P content of 10.7%, 400 mesh or less) were measured and were subjected to ball mill mixing in alcohol for 48 hours. 300 g was extracted from the mixed powder, and 10 g of diamond having a diameter from 40 μm to 50 μm and 9 g of copper thin wires having a length of 5 mm and a diameter of 0.1 mm were added. Mixing was performed in an alcohol solution, followed by drying.

Figure 4:
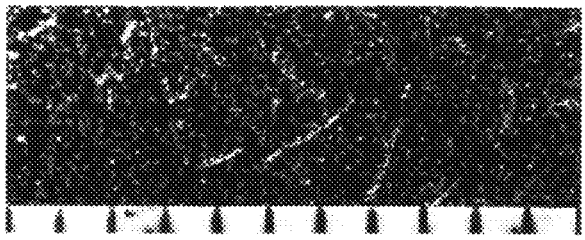
FIG. 4 is a view showing a structure photograph of a wear-resistant composite material according to a second embodiment of the present invention.
Figure 5:
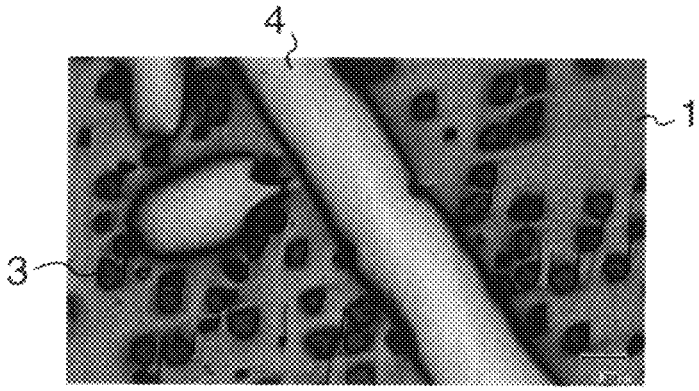
FIG. 5 is a structure photograph of a wear-resistant composite material according to a second embodiment of the present invention.

25 g of the compact powder produced as above was input into a carbon mold having a length of 25 mm and a width of 10 mm, and was subjected to hot pressing in $N_2$ gas at conditions, in which a pressure of 40 MPa and a temperature of 1000° C. were maintained for 30 minutes. It was possible to product a composite wear resistant member in which diamond particles of 10% in volume are distributed across a minute structure of the WC and the phosphor-containing iron group metal. The results observed using an optical microscope are shown in FIGS. 4 and 5. In these figures, the reference numeral 4 designates thin copper lines. In the lower part of FIG. 4 shows the scale of 1 mm, and in the lower right part of FIG. 5 shows the scale of 100 μm. As shown in the figures, the produced composite material is a composite material, in which copper is distributed and scattered, showing a good appearance without defects.

In an attempt to cut the composite wear resistant member by wire discharge processing, it was possible to cut the member without difficulties.

In addition, brazing was also easy due to good lead adaptability, and no defects were observed.

EXAMPLE 3

87 wt % of WC powder having a diameter of 2 μm, 10 wt % of Co having a diameter from 2 μm to 3 μm, and 3 wt % of NiP (P content of 10.7%, 400 mesh or less) were measured and were subjected to ball mill mixing in alcohol for 48 hours. 300 g of the mixed powder A was extracted.

A copper net having 30 mesh and a diameter of 0.3 ϕ was set to a length 25 mm and a width 10 mm, and diamond particles having an average diameter of 500 μm were fixed to the top of the copper net by brazing, in which a temperature of 950° C. was maintained in vacuum for 5 minutes. The copper net, in which the diamond particles are fixed, are referred to as a copper net B.

A copper film C having a thickness 0.1 mm, a length 25 mm, and a width 10 mm was prepared.

4 g of the mixed powder A was input into a carbon mold having a length of 25 mm and a width of 10 mm, and was subjected to pre-pressing at a pressure of 200 kg/cm$^2$. The copper net C, to which the diamond particles were fixed, was placed over the pre-pressed mixed powder. In the same manner, 1 g of the mixed powder A was input, and was subjected to pre-pressing at a pressure of 200 kg/cm$^2$ by placing the copper film C thereon.

Such process sets were referred herein to one cycle, which was repeated four times. Finally, 4 g of the mixed powder A was input, and was subjected to hot pressing in $N_2$ gas at conditions, in which a pressure of 40 MPa and a temperature of 1000° C. were maintained for 30 minutes. It was possible to product a composite wear resistant member in which diamond particles of 10% in volume are distributed across a minute structure of the WC and the phosphor-containing iron group metal.

Figure 6:
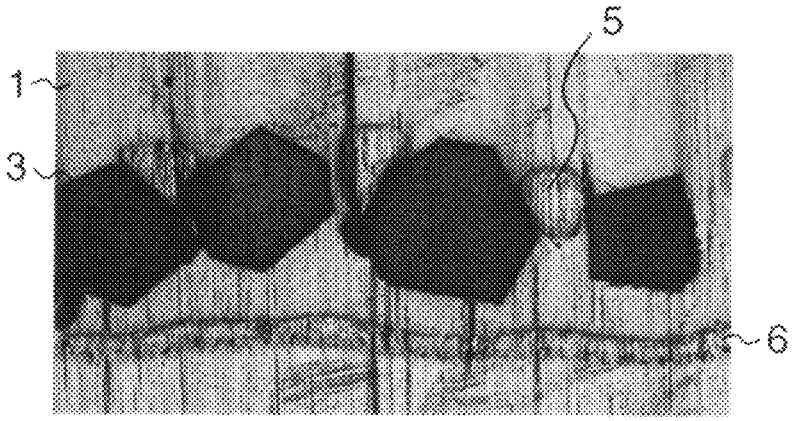
FIG. 6 is a structure photograph of a wear-resistant composite material according to a third embodiment of the present invention.

The result observed using an optical microscope is shown in FIG. 6. In this figure, the reference numeral 5 indicates the copper net, and the reference numeral 6 indicates the copper film.

As shown in these figure, the composite wear resistant member of this example has a good appearance without defects.

In an attempt to cut the composite wear resistant member by wire discharge processing, it was possible to cut the member without difficulties.

In addition, brazing test was fine and no defects occurred.

TEST EXAMPLE

Hardness, Roughness, and the like of WC and Phosphor-Containing Iron Group Metal In order to check the hardness and toughness of WC, which surrounds diamond particles, and phosphor-containing iron group metal, a test sample was prepared by mixing only the WC, which does not contain diamond particles, and the phosphor-containing iron group metal.

A NiP composite material 20 g, which contains 87 WC-10 and Co-3%, was input into a carbon mold having a length of 25 mm and a width of 10 mm. Hot press sintering was performed in vacuum, in which a pressure of 40 MPa and a temperature of 1040° C. were maintained for 30 minutes. Next, physical properties were measured. As a result, the material had a hardness HRA from 90.1 to 90.5 and a toughness Kic of 12.9 $MPa \cdot m^{1/2}$ and the structure was fine.

In addition, a composite material, into which diamond 10% was added, was prepared at a thickness of 25 mm, a width of 10 mm, and a thickness of 8 mm. This was used as a Reference Test Sample.

(Brazing Test)

Three types of tips according to Example 1, Example 2, and Reference Test Sample were silver-brazed using high frequency (JIS: BAg-4) on a steel material having a length of 60 mm, a width of 60 mm, and a thickness of 20 mm (SNCM439). Afterwards, the tips were air-cooled, and workability and cracks were examined.

The results are shown in Table 1 below. Example 1 and Example 2 showed good brazing performance. Minute cracks were observed on the diamond composite material, into which no copper was added.

TABLE 1

| Brazing test | Cu film Example 1 | Cu thin line distributed Example 2 | No Cu Reference Test Sample |
|---|---|---|---|
| Crack | ○ | ○ | Δ |
| Workability | ○ | ○ | Δ |

(Thermal Shock Test)

Three tips according to the three types of materials of Example 1, Example 2, and Reference Test Sample were prepared (a length of 25 mm, a width of 10 mm, and a thickness of 8 mm). The tips were heated for one hour at a $N_2$ atmosphere of 800° C., followed by immersing into quenching oil. The results are shown in Table 2 below.

The test results indicate that the addition of copper is effective in thermal shock.

TABLE 2

| Thermal shock test | Example 1 | Example 2 | Reference Test Sample |
|---|---|---|---|
| Oil cooling at 800° C. | ○○○ | ○○○ | ○XX |

(Rock Abrasion Test)

Two types of materials such as a typical diamond composite material, which does not contain copper, and a stacked composite structure, which contains copper and diamond, were brazed to two pieces of steel material (S45C) using lead (JIS: BAg-4) while being heated at a temperature of about 800° C., followed by slow cooling. In both of the materials, the contents of diamond were 10% (with an average diameter of 400 μm).

Figure 7:
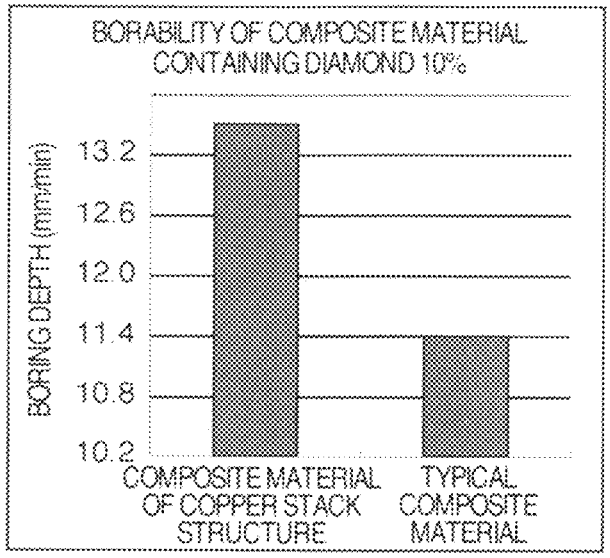
FIG. 7 shows results of measuring a drilling depth of a drilling cutter to which a wear-resistant composite material according to embodiments of the present invention is brazed.

Rocks, in which bottom holes having a diameter of 160 mm were formed in advance, were bored using boring cutters, which were fabricated for test, by mounting the brazed materials thereon. The holes were expanded to a diameter of 200 mm. The boring was performed at a load of 100 $kg/cm^2$ and a speed of 60 m/min for 10 minutes, and then the bored depths (mm/min) were measured. The results are reported in FIG. 7. As shown in FIG. 7, the stacked structure of copper and diamond is very effective.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A composite wear-resistant member comprising a material including hard particles including diamond particles and WC particles, a binder of an iron group metal containing phosphor and copper distributed on a surface of the member and a base layer, which has the hard particles including the diamond particles and the WC particles and the binder of the iron group metal containing the phosphor, and a layer including the copper, wherein the phosphor content is from 0.01 to 1.0 wt % with respect to the sum total of the WC particles and the binder.

2. A composite wear-resistant member comprising a material including hard particles including diamond particles and WC particles, a binder of an iron group metal containing phosphor and copper distributed on a surface of the member, wherein the copper comprises a thin line.

3. The composite wear-resistant member according to claim 2, wherein the phosphor content is from 0.01 to 1.0 wt % with respect to the sum total of the WC particles and the binder.

* * * * *